US005960999A

United States Patent [19]

Wallays

[11] Patent Number: 5,960,999

[45] Date of Patent: Oct. 5, 1999

[54] CONDIMENT DISPENSER

[75] Inventor: Nele Wallays, Antwerp, Belgium

[73] Assignee: Dart Industries Inc., Orlando, Fla.

[21] Appl. No.: 09/045,742

[22] Filed: Mar. 20, 1998

[51] Int. Cl.[6] ..... A47G 19/12; B65D 47/00; B65D 39/00

[52] U.S. Cl. ..... 222/142.2; 222/142.9; 222/487; 222/142.1; 215/236; 220/254; 220/821; 220/822

[58] Field of Search ..... 222/142.1, 142.2, 222/142.9, 135, 138, 140, 481, 487, 545, 556; 215/236; 220/254, 821, 822

[56] References Cited

U.S. PATENT DOCUMENTS

| | | | |
|---|---|---|---|
| 2,185,576 | 1/1940 | Tarantolo | 65/45 |
| 2,668,639 | 2/1954 | Scalf | 222/151 |
| 2,734,663 | 2/1956 | Lucas | 222/142.1 |
| 2,866,580 | 12/1958 | Nissen | 222/512 |
| 2,904,226 | 9/1959 | Gilbert | 222/189 |
| 3,036,746 | 5/1962 | Hagen | 222/480 |
| 3,163,331 | 12/1964 | Wallberg | 222/151 |
| 3,542,235 | 11/1970 | Hidding | 222/153 |
| 4,723,693 | 2/1988 | DeCoster | 222/483 |
| 4,754,898 | 7/1988 | Britt et al. | 220/29 |
| 4,828,130 | 5/1989 | Hofmann | 215/317 |
| 4,887,747 | 12/1989 | Ostrowsky et al. | 222/556 |
| 5,799,838 | 9/1998 | Miller | 222/480 |

*Primary Examiner*—Andres Kashnikow
*Assistant Examiner*—Keats Quinalty
*Attorney, Agent, or Firm*—Taylor J. Ross

[57] ABSTRACT

A condiment dispenser principally intended for use in the storing and dispensing of salt or pepper. The dispenser preferably includes a container housing the condiment, and having one or more pour openings extending therethrough. At least one flow controller is mounted to the container for manual rotation between closed and open positions. In the closed position the flow controller covers the associated pour opening(s). The ensure a proper seal, the flow controller may include an extending plug which seals the pour opening. In the preferred form, two flow controllers are provided, with both mounted to a common lug for rotation about a common axis. Each flow controller is associated with a different number of pour openings, such that the rate of dispensing may be varied. The flow controllers include indicia to indicate the flow rate associated therewith. The flow controllers are mounted to a removable top wall of the container, with a seal being provided about the top wall.

18 Claims, 2 Drawing Sheets

CONDIMENT DISPENSER

CROSS-REFERENCE TO RELATED APPLICATIONS

This application is related to copending design application Ser. No. 29,085,352, filed Mar. 20, 1998 entitled CONDIMENT CONTAINER and having the same inventors.

STATEMENT REGARDING FEDERALLY SPONSORED RESEARCH

Not Applicable.

BACKGROUND OF THE INVENTION

The present invention relates in general to manual dispensers for particulate materials, and especially condiments such as salt and pepper. In particular, the present invention relates to an improved dispenser having a pivoted flow control elements easily actuated with one hand.

Condiment dispensers, most commonly used for salt or pepper, come in a variety of forms which, in most instances, include a container having a dispensing end with at least one, and preferably multiple, pour openings therein. The container will normally include a filling port selectively accessed by a removal of an appropriate cap. Such dispensers, if used for table condiments such as salt and pepper, will normally be provided in pairs, one for salt and one for pepper.

Many condiment dispensers use pour openings which are always open. This, however, permits ingress of moisture and other contaminants which may cause spoilage of the condiment in the dispenser. To prevent ingress of contaminants, it has been known to provide a removable lid which may cover the pour openings. To prevent ingress of moisture, it has been known to form a seal between the container and lid in surrounding relation to the pour openings. Dispensers which can dispense the contained condiments at different rates are also known. Such combination dispensers will normally include two sets of pouring openings, with each set being controlled by a separate lid. The individual lids are normally mounted by separate journals or hinges for the selective opening and closing of the opening(s) associated with each lid.

In many instances when dealing with containers with manually manipulated lids, there is an awkwardness in manipulating the lids. For example, two hands are often required- one to hold the container, and one to open the lid. If the lid is removable, care must be taken to ensure the lid is not lost. Even providing the sealed pivoting lid of the prior art is not without problems. For example, the force to overcome the seal may be near that required to hold the pivoting lid in its journal, such that the lid is often unintentionally removed from its journal upon opening.

SUMMARY OF THE INVENTION

An object of the present invention is to provide a condiment dispenser which safely stores the condiment, and which provides easy dispensing.

Another object of the present invention is to provide such a condiment dispenser which includes at least one lid to seal the dispenser when not in use, with this lid providing a seal against ingress of moisture.

Yet another object of the present invention is to provide such a condiment dispenser in which the lid is easily pivotable, and may be pivoted with the fingers of the same hand which holds the condiment dispenser.

A further object of the present invention is to provide such a condiment dispenser in which two such lids are provided, with each lid being associated with a different number of pour openings, such that the rate of dispensing may be varied.

These and other objects are achieved by a condiment dispenser principally intended for use in the storing and dispensing of salt or pepper. The dispenser preferably includes a container housing the condiment, and having one or more pour openings extending therethrough. At least one flow controller is mounted to the container for manual rotation between closed and open positions. In the closed position the flow controller covers the associated pour opening(s). To ensure a proper seal, the flow controller may include an extending plug which enters and blocks the pour opening. In the preferred form, two flow controllers are provided, with both being mounted to a common lug for rotation about a common axis. Each flow controller is associated with a different number of pour openings, such that the rate of dispensing may be varied. The flow controllers include indicia to indicate the flow rate associated therewith. The flow controllers are mounted to a removable top wall of the container, with a seal being provided about the top wall.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
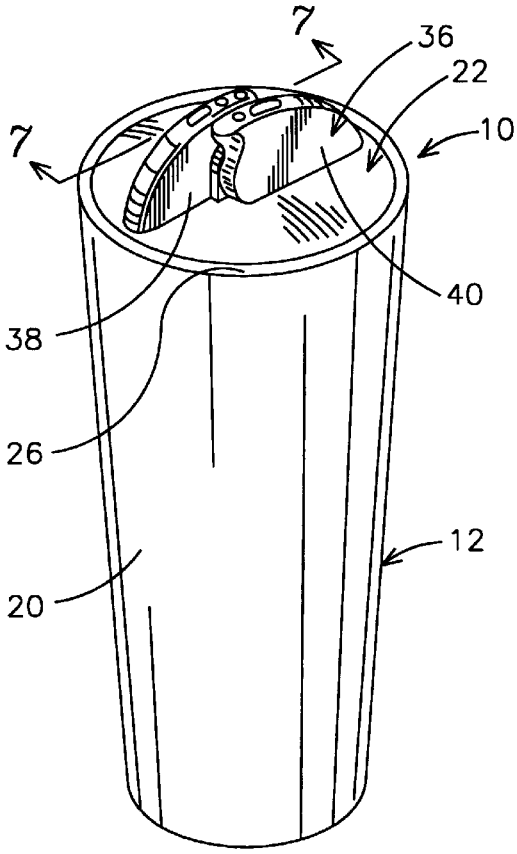
FIG. 1 is a perspective view of a condiment dispenser according to the preferred embodiment of the invention.
Figure 4:
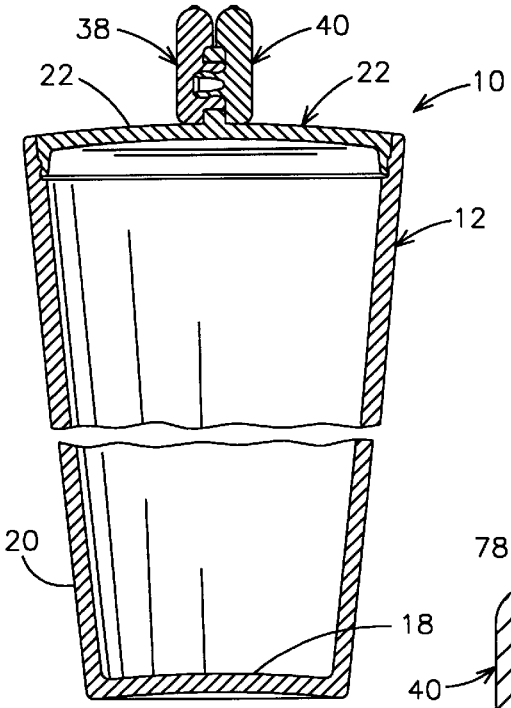
FIG. 4 is a cross-sectional view through the condiment dispenser along line 4—4 of FIG. 1.

With reference to FIG. 1, a condiment dispenser according to a preferred embodiment of the present invention is generally designated by reference numeral 10. The condiment dispenser 10 includes a container 12 defining an interior 14 (FIG. 4) within which the condiment (not shown), preferably salt or pepper, is stored. The container 12 includes at least one pour opening 16 extending therethrough and communicating with the interior 14, such that the condiment may exit from the container 12 via the pour opening 16.

The container 12 is preferably vertically elongated, and includes a bottom wall 18 and a side wall 20 extending upward from the periphery of the bottom wall 18. In the preferred embodiment shown, the bottom wall 18 and side wall 20 are formed as a monolithic unit, preferably by injection molding of a plastic material. This is not required, however, and the bottom wall 18 could be a separate element secured to the side wall 20 by an interference fit, threads, or other means known in the art. In the preferred embodiment shown, the bottom wall 18 is circular, with the side wall 20 forming a tube having a diameter which progressively increases with increasing distance from the bottom wall 18. Again, this is not required, and the bottom wall 18 and side wall 20 may have any cross-sectional shapes desired.

The end of the side wall 20 opposite the bottom wall 18 is closed by a top wall 22. The top wall 22 may be convex, flat, concave (as shown), or have a greater curvature to provide a smooth transition with the side wall 20. The bottom wall 18, side wall 20, and top wall 22 together serve to define the interior 14 of container 12. As noted above, the pour opening 16 extends through the container 12, and as such will extend through at least one of the bottom wall 18, side wall 20 or top wall 22. In the preferred embodiment shown, the pour opening 16 extends through the top wall 22. As with the bottom wall 18, the top wall 22 may be monolithic with the side wall 20, or may be a separate element secured to the side wall 20. In the preferred embodiment shown, the top wall 22 is a separate element.

To secure this separate element, the side wall 20 extends upward to an upper rim 24, which is annular in the embodiment shown. The inner surface of the side wall 20 immediately adjacent the upper rim 24 includes a sealing section 26 in the form of a radially outward offset. In the embodiment shown, the sealing section 26 is continuous about the entire inner periphery of the upper rim 24, but could be formed in plural discrete sections. The offset of the sealing section 26 defines an upwardly facing support shoulder 28, which extends about the entirety of the upper rim 24 in the embodiment shown.

The top wall 22 is formed with a peripheral shape corresponding to that of the upper rim 24, and has a length or size which will provide a firm interference fit with the sealing section 26. Additionally, the top wall 22 may abut against the support shoulder 28 to ensure proper placement of the top wall 22. This interference fit (and the possible abutment against the support shoulder 28) will serve to seal the interior 14 against ingress of contaminants, and against egress of the contents of condiment dispenser 10. As may be envisioned, forming these components as plastic items (with an inherent slight resiliency) will provide a further improved seal. To improve the seal yet more, the top wall 22 may be provided with a peripheral skirt 30 depending therefrom. As with the peripheral edge of the top wall 22, the peripheral skirt 30 is sized and shaped to provide a firm interference fit with the sealing section 26. Additionally, the lower edge of the peripheral skirt 30 may abut against the support shoulder 28, as in the embodiment shown. The increased engagement area provided by the use of peripheral skirt 30 results in increase sealing, and may provide protection against the ingress of moisture.

Yet more sealing protection can be achieved by the provision of a mating locking rib 32 and locking groove 34. The locking rib 32 and locking groove 34 will be provided in those sections which include the sealing section 26, which in the preferred embodiment includes the entire periphery. The size (and in particular depth) and shape of the locking rib 32 and locking groove 34 may vary, but a generally trapezoidal cross-section as shown provides a strong locking action to hold the top wall 22 in position and seal against contamination, while at the same time permitting easy disengagement of the top wall 22 from the sealing section 26. It is also noted that the locking rib 32 may be formed on either of the sealing section 26 or peripheral skirt 30, with the locking groove 34 formed on the other. The particular placement shown in the figures is simply a preferred arrangement. Additionally, if the top wall 22 is sufficiently thick, a locking rib and groove arrangement may be employed without the use of the peripheral skirt 30.

It is noted that the proper placement of the top wall 22 will preferably result in the outer surface of the top wall 22 forming a smooth continuous surface with the outer surface of the side wall 20. This is preferred for aesthetics, and to prevent any cavities which may trap contaminants or dispensed contents of the condiment dispenser 10, but is not required. In this regard, it is also noted that the top wall 22 preferably has a slightly convex shape as shown in the figures. This shape may act as an inclined surface to prevent any of the dispensed condiment (or contaminants) from remaining on the top wall 22.

To further prevent contamination, it is preferred that the condiment dispenser 10 include a flow control assembly, generally indicated by reference numeral 36, for selective opening and closing of the pour opening 16. The flow control assembly 36 includes at least a first flow controller 38, and in the preferred embodiment also includes a second flow controller 40. To mount the flow controller(s), the container 12 includes at least one outwardly extending lug 42 having a transverse bearing aperture 44 therethrough. The lug 42 will be located in the general vicinity of the pour opening 16. In the embodiment shown, the lug 42 extends outward from the top wall 22, and in particular from the central region of the top wall 22. For reasons made clear below, it is preferred that the lug 42 include at least one planar face 46 (through which the aperture 44 extends). It is also preferred, but not required, that the lug 42 include a peripheral edge 48 having at least one vertical end portion 50 and a semicircular or arcuate upper portion 52 providing, in effect, an inverted U-shaped edge configuration.

Figure 2:
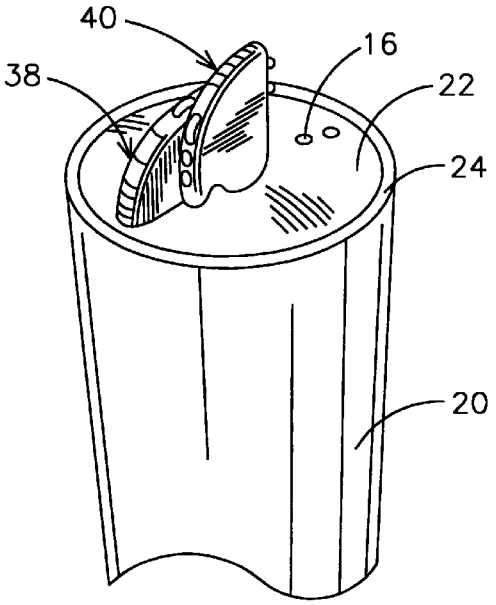
FIG. 2 is a perspective view of the opposite side of the upper portion of the condiment dispenser with one of the flow control members open.

The first flow controller 38 is mounted to the lug 42 for pivotal movement between a closed position and an open position, both shown in FIG. 2. This mounting for pivotal movement may be effected in several ways. In general, a journal member 52 will extend through, and rotate within, the aperture 44, and the first flow controller 38 will be fixed to the journal member 52. The journal member 52 may be a separate element which is assembled to the first flow controller 38, or may be a monolithic portion of the first flow controller 38. It is preferred that at the end opposite the first flow controller 38, the journal member 52 include an enlarged head to hold the journal member 52, and thus the first flow controller 38, to the lug 42. This enlarged head could again be a monolithic portion of the journal member 52, or a separate element secured thereto.

Figure 6:
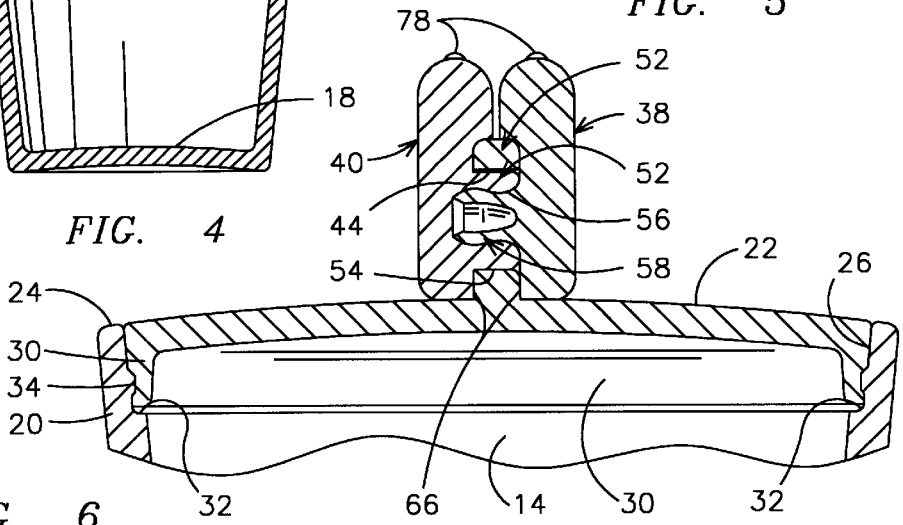
FIG. 6 is an enlarged detail of the upper end of FIG. 4.

In the preferred embodiment, the second flow controller 40 acts as the enlarged head for the first flow controller 38, and vice versa. In particular, the first flow controller 38 and second flow controller 40 are located at opposite faces of the lug 42 and are secured to each other by the journal member 52. Again, this may be achieved in many ways. In the preferred form, one of the flow controllers (as shown, the first flow controller 38) includes a projection 54 having an outer diameter suitable for rotation in the aperture 44, and a female socket 56 open at the free end of projection 54. As shown, projection 54 extends into and is substantially coextensive with the transverse width of the aperture 44. The other of the two flow controllers (as shown, the second flow controller 40) includes a male pin 58 which is received within the female socket 56 and retained therein by a cooperating slightly enlarged free end portion on the male pin 58 and corresponding enlarged internal end of the female socket 56, as best shown in FIG. 6. In the embodiment shown, where the two flow controllers are secured together, the female socket 56 and male pin 58 have a circular cross-section, to permit relative rotation between the first flow controller 38 and second flow controller 40. Alternatively, if only one flow controller is employed, or the flow controllers are mounted to separate lugs 42, one or the other of the flow controllers may be replaced by a simple enlarged head portion. Relative rotation is not believed to be required in this arrangement.

The first flow controller 38 (and any other flow controllers, if used) takes the general form of a centrally pivoted beam which rotates (or more specifically oscillates) between the closed and open positions. More particularly, the flow controller(s) preferably has a sealing projection 60 and an operating projection 62, with the journal member 52 located adjacent or at the corner formed by the projections 60 and 62. In the preferred arrangement, the first flow controller 38 takes the general form of an segment of a circle defined between two radial lines (with these radial lines corresponding to the projections 60 and 62). The arcuate distance between these lines is typically less than approximately 150°, to permit the desired rotation. This results in an arcuate engagement surface 64 for manual manipulation, as described below. This is not required, however, and other aesthetically pleasing shapes are available.

The lateral face of the first flow controller 38 which abuts the lug 42 preferably has a conforming recess 66. In the embodiment shown, both flow controllers 38 and 40 include recesses 66 formed about the female socket 56 and male pin 58. The recess(es) 66 conforms to the peripheral edge 48 and end portion 50 of lug 42, partially covering the lug 42 to the depth of the recess 66. As may be envisioned, as sufficiently deep recess 66 may conceal the entire lug 42 within the first flow controller 38. In the embodiment shown, a recess half as deep is used in each of the first flow controller 38 and second flow controller 40 to conceal the lug 42 in a similar manner. The planar face 46 of the lug 42 acts as a bearing surface to support the first flow controller 38 to ensure that it remains within the desired plane during its rotation from the close to the open position, and back. A close sliding fit between the recess 66 and the peripheral edge 48 (best illustrated in FIG. 5) provides an additional guiding and stabilizing support for the first flow controller 38.

While the first flow controller 38 (and other flow controllers) may take various forms (and need not all have the same form), in the preferred embodiment the first flow controller 38 and second flow controller 40 both are generally flat in cross-section (i.e., in FIGS. 4 and 6) with a transverse thickness sufficient to allow for finger manipulating pressure thereon for movement of the flow controllers. As described above, the flow controllers are shown as being on opposite planar faces 46 of the lug 42. In this preferred embodiment, it is also noted that the sealing projections 60 of the flow controllers extend in opposite directions.

The sealing projection 60 may take whatever configuration permits an abutment of the sealing projection 60 over the pour opening 16. In the embodiment shown, the sealing projection 60 is generally linear, and includes a lower sealing edge 68 which conforms to the outer surface of the container 12 adjacent the associated pour opening 16. As such, in the embodiment shown, the sealing edge 68 is actually slightly concave. In a similar manner, the operating projection 62 may take a wide variety of forms. In the preferred embodiment shown, the operating projection 62 has a generally sinusoidal configuration with a convex lower portion, the arc of which is generally defined about the rotation axis of the journal member 52 to allow for an unencumbered rotation of first flow controller 38 between the open and closed positions. The outer end of the preferred sinusoidal form defines a rearwardly directed overhanging lip 70.

Figure 5:
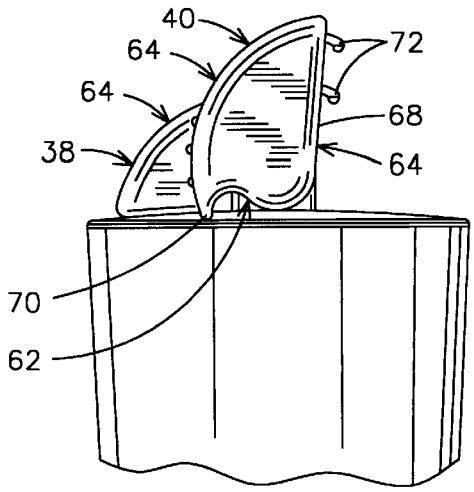
FIG. 5 is an elevation view of the cap end of the dispenser with one control member open.

While the first flow controller 38 and lug 42 (or journal member 52) may be defined to abut and thus halt movement when the first flow controller 38 reaches the closed position, the closed position could also be defined by the abutment of the lip 70 against the outer surface of the container 12, as shown in FIG. 5. The lip 70 could also be used as a convenient point to apply manual pressure to move the first flow controller 38 between the open and closed positions. The force applied to lip 70 in a first direction tangent to journal member 52 will move the first flow controller 38 from the open to the closed position, and similarly, a force in the opposite direction will move the first flow controller 38 back to the open position. In the embodiment shown, the engagement surface 64 also acts as an area where manual pressure may be applied to cause this movement. The surface of the engagement surface 64 may be appropriately roughened or knurled to provide increased friction if desired, or for providing information, as described more fully below.

The actual dispensing of the condiment is effected through the pour opening 16. As noted above, there may be more than one such pour opening 16, and even more than one pour opening 16 associated with each flow control member. The pour opening 16 and first flow controller 38 are arranged such that the operating projection 62 (and possibly lower sealing edge 68) are located in proximity to the associated pour opening 16 when the first flow controller 38 is in the closed position. If the operating projection 62 is in sufficiently close covering relation to the associated pour opening(s) 16 (and the first flow controller 38 will not freely move from this position, such as by being held by force of friction), this may be sufficient for some uses. To improve the sealing and thus reduce contamination or unintentional dispensing, the first flow controller 38 may be provided with a plug 72 associated with, and intended to seal each associated pour opening 16.

The plug 72 will extend outward from the first flow controller 38 at a position such that the free end of the plug 72 will enter the associated pour opening 16 as the first flow controller 38 approaches the closed position. While the plug 72 could be a separate element secured to the first flow controller 38, it is preferred that it be a monolithic extension of the first flow controller 38. To provide the most effective sealing (and thus aid in preventing ingress of moisture) it is preferred that the plug 72 is of a peripheral configuration so as to frictionally engage with the associated pour opening 16. While not required, it is preferred that the plug 72 also have a length at least equal to the full depth of the associated pour opening 16, such that entry of the plug 72 into the pour opening 16 will automatically clear the pour opening 16 of any condiment remaining in the pour opening 16. If the plug 72 has a sufficient length (as in the preferred embodiment), it may be required to form the plug 72 with an arc along its length. This will facilitate engagement within the pour opening 16 as the first flow controller 38 is rotated toward the closed position. The radius of the arc for the plug 72 will be approximately equal to the length of the plug 72 from the axis of the journal member 52.

Figure 7:
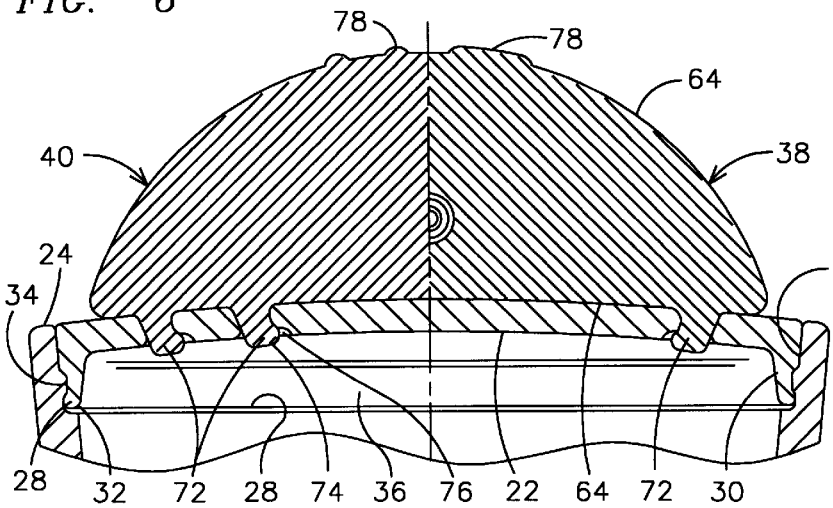
FIG. 7 is a cross-sectional detail through the cap taken along line 7—7 of FIG. 1.

The plug 72 may also be used to provide a more secure retention of the first flow controller 38 in the closed position (to thus prevent unintended dispensing of the condiment). In particular, the free end of the plug 72 may include an enlarged retention head 74. If the plug 72 is formed with the length sufficient to place the retention head 74 completely through the pour opening 16, its increased size will resist unintended opening of the pour opening 16. The resilient nature of the material forming the pour opening 16 and/or plug 72 will, however, permit manual removal of the plug 72 by the application of force to the operating projection 62 and/or engagement surface 64 as described above. To reduce the required length of the plug 72, the inner surface of the container 12 may be provided with an undercut 76 about the pour opening 16, as best shown in FIG. 7.

As noted above, the actual number, size and placement of pour openings 16 may vary from the embodiment shown, as may the number and placement of flow controllers. In this regard, however, it is noted that the number and size of the pour openings 16 affects the amount of condiment which will be dispensed. For example, in the illustrated embodiment, a single pour opening 16 underlies the lower sealing edge 68 of first flow controller 38, while two pour opening 16 underlie second flow controller 40. As such, if the sizes of the pour openings 16 are the same, the user may dispense twice as much condiment by opening second flow controller 40, rather than first flow controller 38.

If multiple flow controllers are used, and they provide different dispensing rates, it may be desired to provide an indication of these different rates. Visual indicators could of course be employed on or adjacent to the flow controllers. It is preferred, however, to provide the different flow controllers with manually discernable indicia representing the different dispensing rates. This indicia may take the form of raised areas, lowered areas, areas of different texture, etc. Additionally, the indicia may take the form of numbers, letters, symbols, etc. to indicate flow rate. In the preferred embodiment, each of the flow controllers is provided with one or more gripping bumps 78. The number of gripping bumps 78 provided is illustrated as being equal to the number of pour openings 16 associated with the flow controller. The size of the indicia may also be varied to act as an indicator for the relative size of the pour opening 16, as illustrated by the large single gripping bump 78 on the right in FIG. 7, compared to the two smaller gripping bumps 78 on the left.

Figure 3:
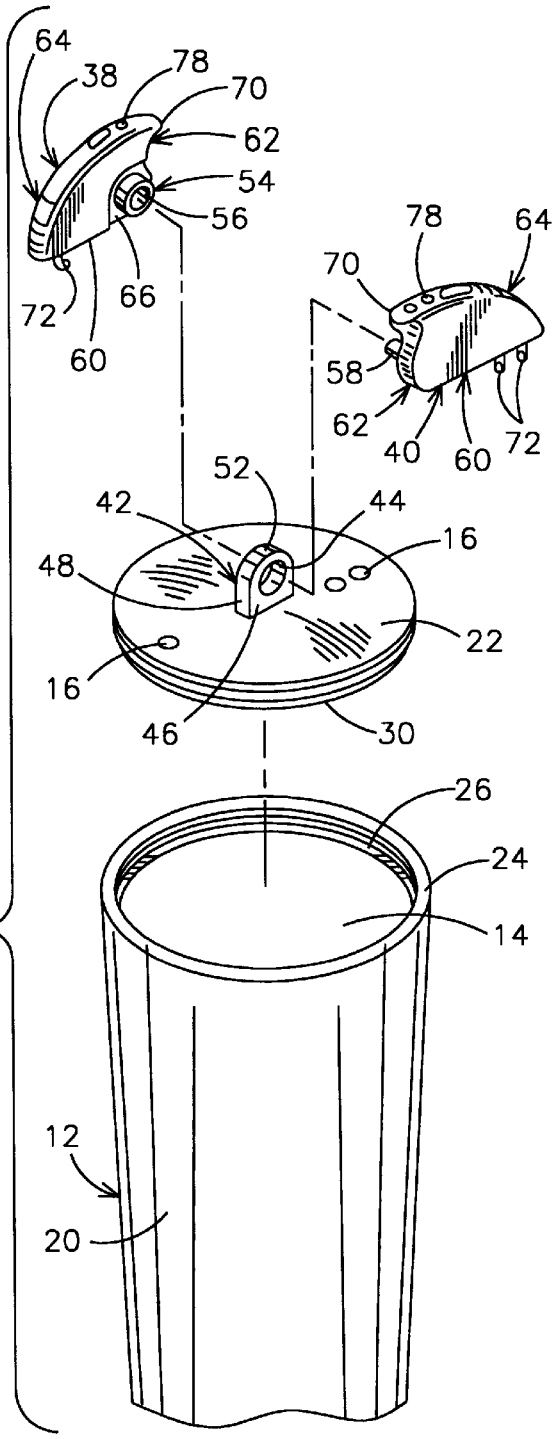
FIG. 3 is an exploded perspective view of the upper portion of the container, the sprinkler cap and the two flow control members.

As will be noted in FIG. 3, inasmuch as the first flow controller 38 and second flow controller 40 of the preferred embodiment are positioned in adjacent parallel relation to each other on opposite sides of the lug 42, the two sets of pour openings 16, a set comprising one or more pour openings 16, will be slightly laterally offset to a true diametric line so as to properly align under the respective flow controllers. As the flow controllers are mounted on the top wall 22, there is no required user alignment of the top wall 22, with its mounting being effected by merely an alignment of the top wall 22 over the upper rim 24 and a downward pressure thereon.

Referring again to the flow control assembly 36, while rotation between the flow controllers should be easily effected by manual pressure, there is preferably sufficient frictional resistance between the various elements of the aperture 44 and journal member 52 to maintain each of the flow controllers in an adjusted position intermediate of the open and closed position. In addition, for the illustrated embodiment it will be noted that the manual rotation of one of the flow controllers relative to the other will tend to more firmly engage the other flow controller in its sealed position, thus ensuring the dispensing at the desired rate. Alternatively, if so desired, both of the flow controllers can be moved to the open positions for a simultaneous dispensing through both sets of pour opening 16. The use of the two flow controllers, mounted to a common lug 42, perform an additional significant function in providing a large handle or grip area which can be easily grasped for a vertical removal of the top wall 22 from the upper rim 24. Without this arrangement, removal of the top wall 22 would be much more difficult, due to the desired flush engagement of the top wall 22 with the side wall 20.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A condiment dispenser comprising a container having an upwardly opening mouth, a dispenser cap overlying and closing said mouth, said cap including a top panel with dispensing holes defined therein, a pair of adjacent flow control members, said members extending outward from said top panel in parallel adjacent vertical planes, pivot means transverse to said control members for pivotally joining said control members to said top panel for individual rotation of each of said control members in the vertical plane thereof between an open position and a closed position, each control member having a lower sealing edge which, in the closed position, is in closely overlying relation to said top panel, said dispensing holes underlying said sealing edges with at least one of said holes underlying said sealing edge on each control member for closure of said at least one hole in said closed position of the corresponding control member.

2. The condiment dispenser of claim 1 wherein each sealing edge has an integral depending plug thereon for each underlying hole, said plugs being received within and through said holes in said closed position for cleaning and sealing of said holes.

3. The condiment dispenser of claim 2 wherein said container mouth is defined by a peripheral rim, said top panel of said cap being flush with said rim peripherally thereabout, said control members defining an outwardly extending handle for selective removal of said cap from said container mouth.

4. The condiment dispenser of claim 3 wherein said pivot means comprises a lug rigid with and projecting upward from said top panel generally centrally thereof, said lug defining a bearing, said control members including journal means for rotatably mounting said control members to said bearing.

5. The condiment dispenser of claim 4 wherein said journal means comprises a substantially rigid projection on each control member, said projections being laterally directed toward each other, one of said projections defining a laterally opening socket, a second of said projections defining a pin rotatably received within said socket, said control members being positioned to the opposite sides of the said lug with said projections rotatably received within said bearing defined by said lug.

6. The condiment dispenser of claim 5 wherein each of said control members includes an inner face, said inner faces being inwardly directed toward each other with said lug therebetween, each of said inner faces having a recess defined therein about the corresponding projection, each said recess partially receiving said lug therein for a substantial concealment of said lug between said control members.

7. The condiment dispenser of claim 6 wherein the lower sealing edge of each control member has a first inner end and a second outer end, an inner edge extending substantially perpendicular from said lower edge at said first end thereof, and an outer edge extending along an arc from said second end and terminating at said inner edge to define a generally right angle segment configuration.

8. The condiment dispenser of claim 7 wherein said inner edge is of a generally sinusoidal configuration with a convex lower portion generally arcing about a rotation axis defined by said journal means, and an upper portion forming a projecting lip within the plane of the corresponding member and in upwardly spaced relation from said convex lower portion, said inner edge and said lower edge of each control member defining a inner lower corner area, said journal means projections extending from said lower corner areas.

9. The condiment dispenser of claim 8 including friction enhancing bumps on said outer edge of each control member adjacent the corresponding inner edge thereof.

10. The condiment dispenser of claim 1 wherein said pivot means comprises a lug rigid with and projecting upward from said top panel generally centrally thereof, said lug defining a bearing, said control members including journal means for rotatably mounting said control members to said bearing.

11. The condiment dispenser of claim 10 wherein said journal means comprises a substantially rigid projection on each control member, said projections being laterally directed toward each other, one of said projections defining a laterally opening socket, a second of said projections defining a pin rotatably received within said socket, said control members being positioned to the opposite sides of the said lug with said projections rotatably received within said bearing defined by said lug.

12. The condiment dispenser of claim 11 wherein each of said control members includes an inner face, said inner faces being inwardly directed toward each other with said lug therebetween, each of said inner faces having a recess defined therein about the corresponding projection, each said recess partially receiving said lug therein for a substantial concealment of said lug between said control members.

13. The condiment dispenser of claim 12 wherein the lower sealing edge of each control member has a first inner end and a second outer end, an inner edge extending substantially perpendicular from said lower edge at said first end thereof, and an outer edge extending along an arc from said second end and terminating at said inner edge to define a generally right angle segment configuration.

14. The condiment dispenser of claim 13 wherein said inner edge is of a generally sinusoidal configuration with a convex lower portion generally arcing about a rotation axis defined by said journal means, and an upper portion forming a projecting lip within the plane of the corresponding member and in upwardly spaced relation from said convex lower portion, said inner edge and said lower edge of each control member defining a inner lower corner area, said journal means projections extending from said lower corner areas.

15. The condiment dispenser of claim 1 wherein said container mouth is defined by a peripheral rim, said top panel of said cap being flush with said rim peripherally thereabout, said control members defining an outwardly extending handle for selective removal of said cap from said container mouth.

16. The condiment dispenser of claim 1 wherein the lower sealing edge of each control member has a first inner end and a second outer end, an inner edge extending substantially perpendicular from said lower edge at said first end thereof, and an outer edge extending along an arc from said second end and terminating at said inner edge to define a generally right angle segment configuration.

17. The condiment dispenser of claim 16 wherein said inner edge is of a generally sinusoidal configuration with a convex lower portion generally arcing about a rotation axis defined by said journal means, and an upper portion forming a projecting lip within the plane of the corresponding member and in upwardly spaced relation from said convex lower portion, said inner edge and said lower edge of each control member defining a inner lower corner area, said journal means projections extending from said lower corner areas.

18. The condiment dispenser of claim 17 including friction enhancing bumps on said outer edge of each control member adjacent the corresponding inner edge thereof.

* * * * *